US005333401A

United States Patent [19]

Klein

[11] Patent Number: 5,333,401

[45] Date of Patent: Aug. 2, 1994

[54] CARPET SEAMING IRON WITH AIR GAP BETWEEN COOLING PLATES

[75] Inventor: James H. Klein, Fontana, Calif.

[73] Assignee: Roberts Consolidated Industries, Inc., City of Industry, Calif.

[21] Appl. No.: 11,753

[22] Filed: Feb. 1, 1993

[51] Int. Cl.[5] ..... D06F 75/30

[52] U.S. Cl. ..... 38/89; 38/95

[58] Field of Search ..... 38/74, 81, 88, 89, 91, 38/93, 82, 95

[56] References Cited

U.S. PATENT DOCUMENTS

| | | | |
|---|---|---|---|
| 1,395,635 | 11/1921 | Finizio | 38/89 X |
| 1,529,922 | 3/1925 | Russell | 38/89 X |
| 1,723,561 | 8/1929 | Lavoie | 219/25 |
| 2,180,399 | 11/1939 | Clark | 38/89 X |
| 2,186,930 | 1/1940 | Scharf | 219/25 |
| 2,276,726 | 3/1942 | Huffman | 38/89 |
| 2,321,509 | 6/1943 | Olving | 38/79 |
| 2,325,017 | 7/1943 | Gough | 38/89 |
| 2,362,590 | 11/1944 | Smith | 38/89 |
| 2,371,257 | 3/1945 | Olving | 38/89 |
| 2,373,345 | 4/1945 | Scharf | 38/89 |
| 2,418,285 | 4/1947 | Witzel | 38/88 |
| 2,500,091 | 3/1950 | Parr | 113/108 |
| 3,486,256 | 12/1969 | Kapr et al. | 38/88 |
| 3,523,176 | 8/1970 | Hill | 219/245 |
| 3,582,436 | 6/1971 | Bucher | 156/502 |
| 3,590,214 | 6/1971 | Kuzyk | 38/88 X |
| 3,972,768 | 8/1976 | Hill | 38/88 X |
| 4,685,229 | 8/1987 | Moravek et al. | 38/93 X |

FOREIGN PATENT DOCUMENTS

| | | |
|---|---|---|
| 144543 | 7/1951 | Austria . |
| 0168899 | 9/1984 | Japan . |
| 1244397 | 4/1985 | Japan . |
| 007698 | of 1906 | United Kingdom . |
| 454908 | 10/1936 | United Kingdom . |
| 679289 | 9/1952 | United Kingdom . |

OTHER PUBLICATIONS

Heat-Bond Seaming Instructions, the Roberts Method, Roberts Consolidated Industries Inc., Apr. 1990.

*Primary Examiner*—Clifford D. Crowder
*Assistant Examiner*—Ismael Izaguirre
*Attorney, Agent, or Firm*—Harris, Wallen, MacDermott & Tinsley

[57] ABSTRACT

A cooling structure for an electric iron having a sole plate, a heater carried at the sole plate, an electric circuit for the heater, and a housing mounted on the sole plate, and further including a lower flow path defining sheet and an upper flow path defining sheet, with the lower and upper sheets mounted on the sole plate with a substantially uniform spacing between the lower and upper sheets, with the lower sheet engaging the sole plate around the periphery of the lower sheet, and with the sheets being generally flat with downwardly sloping leading, side and trailing edges.

2 Claims, 2 Drawing Sheets

CARPET SEAMING IRON WITH AIR GAP BETWEEN COOLING PLATES

BACKGROUND OF THE INVENTION

This invention relates to electric irons and in particular, to a new and improved electric iron suitable for heat sealing of seams during laying of carpet.

Carpet sealing tape with a thermal adhesive layer is widely used in joining the edges of sections of carpet, and relatively high heat sources are ordinarily used in such electric irons. It is an object of the present invention to provide a new and improved cooling structure for an electric iron suitable for use in heat sealing of carpet, while protecting the carpet material from deforming or burning.

A variety of cooling structures for electric irons have been proposed in the past. U.S. Pat. No. 2,321,509 to Olving shows a structure with a large mass 27 of insulating material positioned between the sole plate and the housing, with an air flow path along the interior surface of the housing. A variation on this design is shown in U.S. Pat. No. 2,371,257 to Olving with an air inlet along the front and side edges and an air outlet above the housing at the rear end of the handle.

Another form of cooling arrangement is shown in U.S. Pat. No. 2,186,930 to Scharf. This design also utilizes a mass of insulation 35 over the sole plate, with an air flow path between this mass and the housing leading to a motor driven fan at the rear end of the housing. A variation on this design is shown in U.S. Pat. No. 2,373,345 to Scharf. Other motor driven fan designs are shown in U.S. Pat. Nos. 2,362,590 to Smith and 2,629,949 to Gerber et al.

U.S. Pat. No. 2,325,017 to Gough shows an iron with a fold down handle with slots along the side edges between the sole plate and top. U.S. Pat. No. 2,276,726 to Huffman shows another design with a large volume between the sole plate and housing with two narrow slots around the housing providing for air flow.

The designs of heat seaming irons presently in use do not have a means of reducing the temperature of the heatshield. Previous designs with fans proved to be too bulky. Other designs provide a plastic cover for the heatshield but it does not cover the majority of the heatshield and over time will deform. The design of the present invention provides a means of reducing the heatshield temperature without the bulk of the fan mechanism while still maintaining the basic design dimensions and criteria required by the carpet installation trade.

SUMMARY OF THE INVENTION

It is a particular object of the present invention to provide a new and improved cooling structure for an electric iron which has increased heat transfer and heat dissipation capabilities while at the same time being light in weight and avoiding the use of quantities of insulation. Another particular object is to provide an iron with a cooling structure having a low profile and narrow superstructure suitable for moving along the seam line between pieces of carpet, while at the same time being easy to handle and reducing the likelihood of deformation or burns. A further object is to provide such a cooling structure with a controlled flow path that will induce substantial air flow therethrough without requiring a fan or blower.

The presently preferred embodiment of the electric iron cooling structure includes a sole plate, a heater carried at the sole plate, an electric circuit for the heater, and a housing mounted on the sole plate, and further includes a lower flow path defining sheet, an upper flow path defining sheet, and means for mounting the lower and upper sheets on the sole plate with a substantially uniform spacing between the lower and upper sheets, with the lower sheet engaging the sole plate around the periphery of the lower sheet, and with the sheets being generally flat with downwardly sloping leading, side and trailing edges.

Further in the preferred embodiment of the cooling structure, the sole plate and lower and upper sheets are rectangular in plan form, with the length to width ratio of the sheets is in the range of about 3 to 1 to about 4 to 1, and with the slope of the leading and side edges providing an upward flow path at about 45° to the horizontal and the slope of the trailing edges provides a downward flow path at about 20° to the horizontal.

Further in the preferred embodiment, the ratio of the overall height of the iron to the height of the sole plate and lower and upper sheets is in the range of about 3 to 1 to about 4 to 1, and the ratio of the overall width of the sole plate and lower and upper sheets to the width of the housing is in the range of about 1½ to 1 to about 3 to 1, thereby providing the described shape for easy and effective carpet seaming.

The invention also comprises novel details of construction and novel combinations and arrangements of parts together with other objects, advantages, features and results which will more fully appear in the course of the following description.

DESCRIPTION OF THE PREFERRED EMBODIMENT

Figure 1:
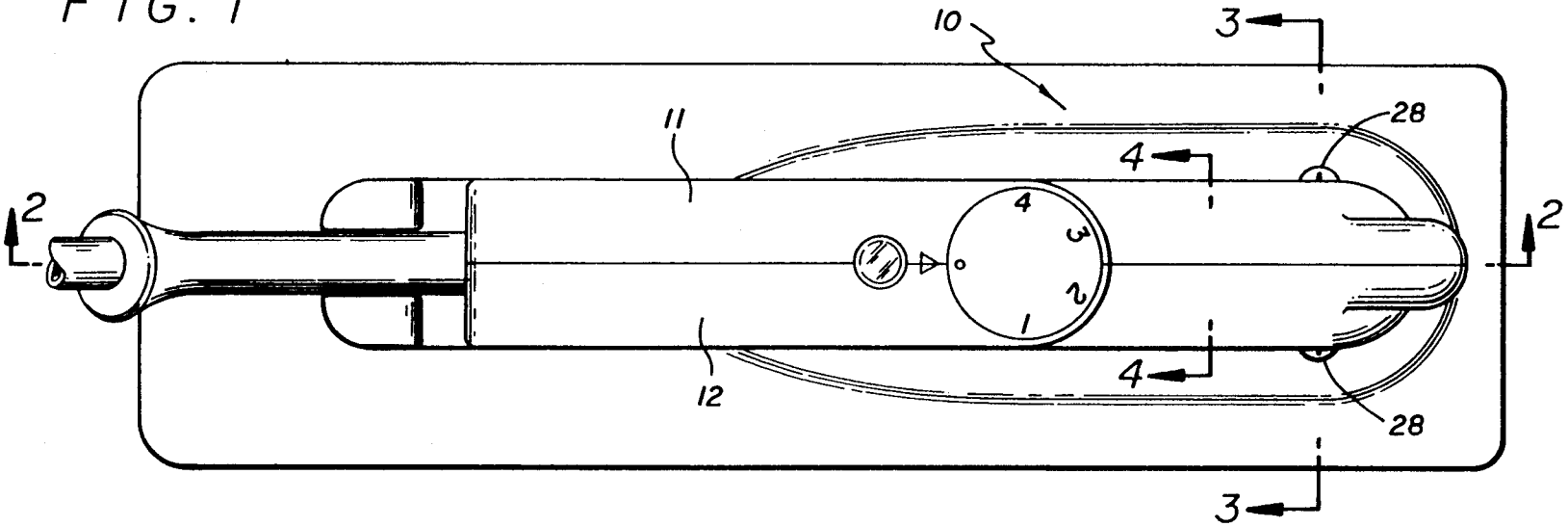
FIG. 1 is a top plan view of an electric iron incorporating the presently preferred embodiment of the invention.
Figure 4:
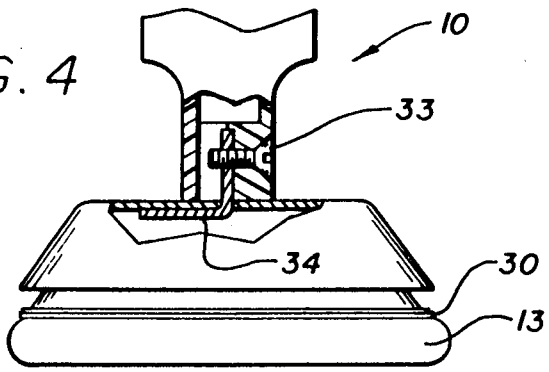
FIG. 4 is a transverse sectional view taken along the line 4—4 of FIG. 1.

The iron of the invention includes a housing 10 formed of housing members 11, 12 and a sole plate with a lower sole unit 13 and upper sole unit 14 with an electric resistance heater 15 positioned therebetween. The housing members 11, 12 are fastened together by screws 17 and 18 with an electric circuit 19 therein. The electric circuit typically includes a cord 20 with reinforcing sleeve 21 where the cord enters the housing, a terminal board 22, and a pilot light 23, with conductors leading to the heater 15, a temperature sensor 16 mounted in the sole plate, and a ground connection 16*a*. A temperature setting unit in the electric circuit is controlled by a knob 24 and shaft 25 mounted in the housing 10. The construction thus far described is conventional and various housing, sole plate, electric heater and circuit arrangements can be utilized.

Figure 3:
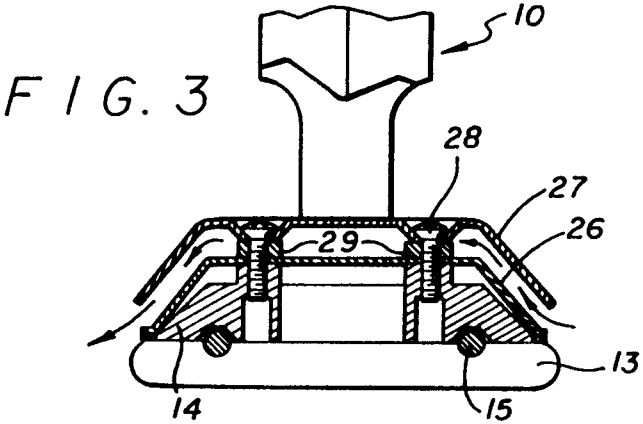
FIG. 3 is a transverse sectional view taken along the line 3—3 of FIG. 1.

The cooling structure of the iron includes a lower flow path defining sheet 26 and an upper flow path defining sheet 27, typically metal stampings. The sheets are joined together and to the sole plate by screws 28 and spacers 29. The dimensions of the components supporting the lower and upper flow path defining sheets are selected such that the space between the two sheets is substantially uniform from the front to the rear of the iron and transversely. The periphery of the lower sheet engages the sole plate around the periphery of the lower sole unit 13, preferably with a peripheral gasket 30 therebetween. The lower and upper sheets are generally flat, with downwardly sloping leading, side and trailing edges, as best seen in the sectional views of FIGS. 2 and 3.

Preferably, the slope of the leading edges of the sheets 26, 27 are at about 45° to the horizontal, the slope of the side edges are about 75° to the horizontal, and the slope of the trailing edges are at about 15° to the horizontal.

The upper and lower sheet configuration provides a flow path for cooling air flow upward into the space between the sheets adjacent the forward end of the iron and downward from the space adjacent the rear end of the iron. The air generally will flow from the front to the rear of the iron because the iron is pushed forward in use.

The housing 10 is mounted on the upper sheet 27 by screws 33, engaging angle brackets 34 which are welded to the upper sheet 27, typically by spot welding. A sheet 35 is attached on top of the sheet 27 by a pressure sensitive adhesive and functions as a gasket between the housing 10 and the upper sheet 27.

Figure 2:
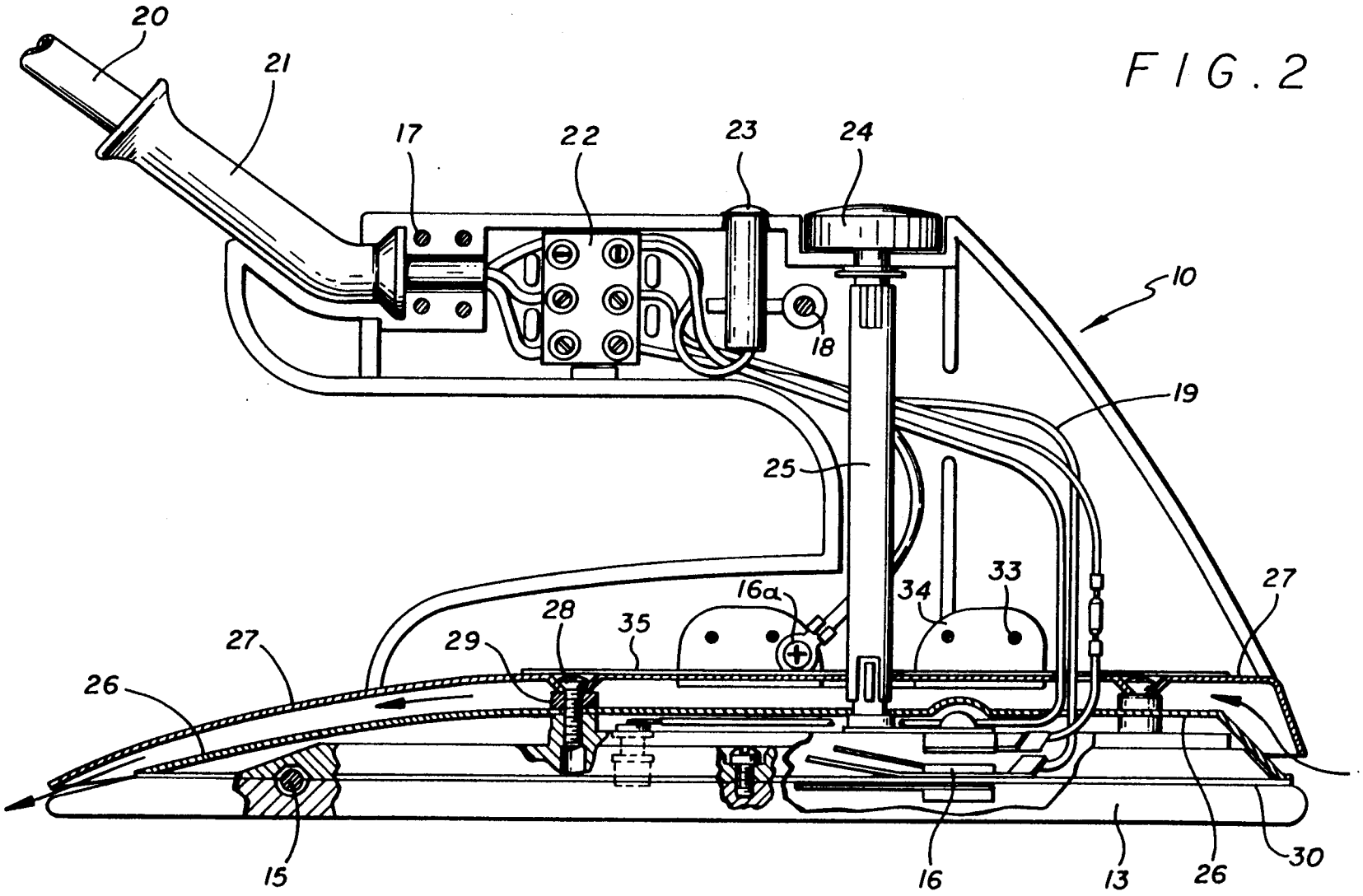
FIG. 2 is a longitudinal sectional view taken along the line 2—2 of FIG. 1.

In the preferred embodiment illustrated, the sole plate and lower and upper sheets are rectangular in plan, preferably with a length to width ratio in the range of about 5 to 1 to 5 to 2. This relationship is seen in FIG. 1. Also, the sole plate and lower and upper sheets have a low profile and the housing is relatively narrow, so that the iron can be moved along the carpet edges to be seamed with a minimum of disturbance. Preferably, the ratio of the overall height of the iron to the overall height of the sole plate and lower and upper sheets is in the range of about 3 to 1 to about 4 to 1. This configuration is seen in FIG. 2.

Also, the ratio of the overall width of the sole plate and lower and upper sheets to the width of the housing is in the range of about 1½ to 1 to about 3 to 1. This is seen in the plan view of FIG. 1 and the sectional view of FIG. 3.

I claim:

1. A cooling structure for an electric carpet seaming iron having a sole plate, a heater carried at the sole plate, an electric circuit for the heater, and a housing mounted on the sole plate, including in combination:

a lower flow path defining sheet;

an upper flow path defining sheet; and means for mounting said lower and upper sheets on said sole plate with a substantially uniform spacing between said lower and upper sheets, width said lower sheet spaced upward from said sole plate and engaging said sole plate around the periphery of said lower sheet, with the periphery of said upper sheet overlying the periphery of said lower sheet defining an air flow path over the entire lower sheet, with said sheets being generally flat from front to rear and side to side, with downwardly sloping leading, side and trailing edges, with said sole plate and lower and upper sheets rectangular in plan form, with the length to width ratio of said sheets in the range of about 3 to 1 to about 4 to 1, with the ratio of the overall height of said iron to the height of said sole plate and lower and upper sheets in the range of about 3 to 1 to about 4 to 1, with the ratio of the overall width of said sole plate and lower and upper sheets to the width of said housing in the range of about 1½ to 1 to about 3 to 1, and with said housing unit having a neck portion of reduced width where said housing joins said upper sheet.

2. A cooling structure as defined in claim 1, wherein the slope of said leading edges provides an upward flow path at about 45° to the horizontal and the slope of said trailing edges provides a downward flow path at about 15° to the horizontal.

* * * * *